US006280145B1

(12) United States Patent
Liu

(10) Patent No.: US 6,280,145 B1
(45) Date of Patent: Aug. 28, 2001

(54) SUSPENDING STRUCTURE OF CEILING FAN

(75) Inventor: Ching Wen Liu, Feng-Yuan (TW)

(73) Assignee: Pan Air Electric Co., Ltd. (TW)

( * ) Notice: Subject to any disclaimer, the term of this patent is extended or adjusted under 35 U.S.C. 154(b) by 0 days.

(21) Appl. No.: 09/499,215

(22) Filed: Feb. 7, 2000

(51) Int. Cl.[7] ..... F04D 29/18
(52) U.S. Cl. ..... 416/244 R
(58) Field of Search ..... 416/5, 244 R, 416/210 R; 248/342, 343, 344

(56) References Cited

U.S. PATENT DOCUMENTS

| | | | | |
|---|---|---|---|---|
| 4,448,388 | * | 5/1984 | Dennis et al. | 248/663 |
| 5,090,654 | * | 2/1992 | Ridings et al. | 248/343 |
| 5,947,436 | * | 9/1999 | Bucher et al. | 248/345 |
| 5,984,640 | * | 11/1999 | Wang | 416/244 R |
| 6,042,072 | * | 3/2000 | Chi-Nan | 248/343 |

* cited by examiner

*Primary Examiner*—Edward K. Look
*Assistant Examiner*—Ninh Nguyen
(74) *Attorney, Agent, or Firm*—Charles E. Baxley, Esq.

(57) ABSTRACT

A suspending structure of a ceiling fan is disclosed. Since in the prior art suspending structure of a ceiling fan, the swinging angle of a swinging pipe set is confined by the assembly hole of a suspender, a swinging pipe set, a hanging bell and other components. Therefore, the swing is pre-formed in a small angle. For a surface (such as ceiling) with a large inclined angle, it can not be used and is very dangerous. Therefore, in the present invention, two sides of the assembly hole of a suspender are formed with a cavity and an opening, and the engaging hole of the hanging bell is formed with long sides. Two ends of the long side are placed on the cavity and opening of the suspender. Thereby, as the swinging pipe set shifts toward said cavity, said swinging pipe is received within one end of said long side of the cavity. Therefore, a swing of large angle is generated, moreover, said swinging path of the swinging pipe set is confined by said buckle and said trench. Thus, the suspending structure according to the present invention can be suitable for a non-horizontal surface with a large angle shift safely.

2 Claims, 6 Drawing Sheets

SUSPENDING STRUCTURE OF CEILING FAN

FIELD OF THE INVENTION

The present invention relates to a suspending structure of a ceiling fan. Two sides of the assembly hole of a suspender is formed with a cavity and an opening, and the engaging hole of the hanging bell is formed with long sides. Two ends of the long side are placed on the cavity and opening of the suspender. Thereby, as the swinging pipe set shifts toward said cavity, said swinging pipe is received within one end of said long side of the cavity. Therefore, a swing of large angle is generated, moreover, said swinging path of the swinging pipe set is confined by said buckle and said trench. Thus, the suspending structure according to the present invention can be suitable for a non-horizontal surface with a large angle shift safely.

BACKGROUND OF THE INVENTION

FIG. 1 shows a prior art suspending structure of a ceiling fan. The prior art suspending structure is formed by a suspender 10, a swinging pipe set 11 and a hanging bell 12. The suspender 10 is installed with an assembly hole 101 so that the hemisphere hanging head 111 can be installed within the assembly hole 101 and is swingable through a small swing angle. The bottom of the hanging bell 12 is formed with a round through hole 121 for being passed through by the swinging pipe 112 of the swinging pipe set 11 and then the hanging bell 12 is combined to the suspender 10 as a shielding body of the suspending structure of a ceiling fan.

In the prior art, the suspending structure of a ceiling fan, the swinging angle of the swinging pipe set in the suspender is confined by the assembly hole of the suspender, swinging pipe set, hanging bell and other factors about the safety and construction. Therefore, it can be installed to a general horizontal ceiling. For an installing surface with a large slope, not only it can not be installed thereto, but also is not safe.

SUMMARY OF THE INVENTION

Accordingly, the primary object of the present invention is to provide a suspending structure of a ceiling fan, wherein, two sides of the assembly hole of a suspender is formed with a cavity and a opening, and the engaging hole of the hanging bell is formed with long sides. Two ends of each long side are placed on the cavity and opening of the suspender. Thereby, as the swinging pipe set shifts toward said cavity, said swinging pipe is received within one end of said long side of the cavity. Therefore, a swing of large angle is generated, moreover, said swinging path of the swinging pipe set is confined by said buckle and said trench. Thus, the suspending structure according to the present invention can be suitable for a non-horizontal surface with a large angle shift safely.

The various objects and advantages of the present invention will be more readily understood from the following detailed description when read in conjunction with the appended drawing.

DETAILED DESCRIPTION OF THE PREFERRED EMBODIMENTS

Figure 1:
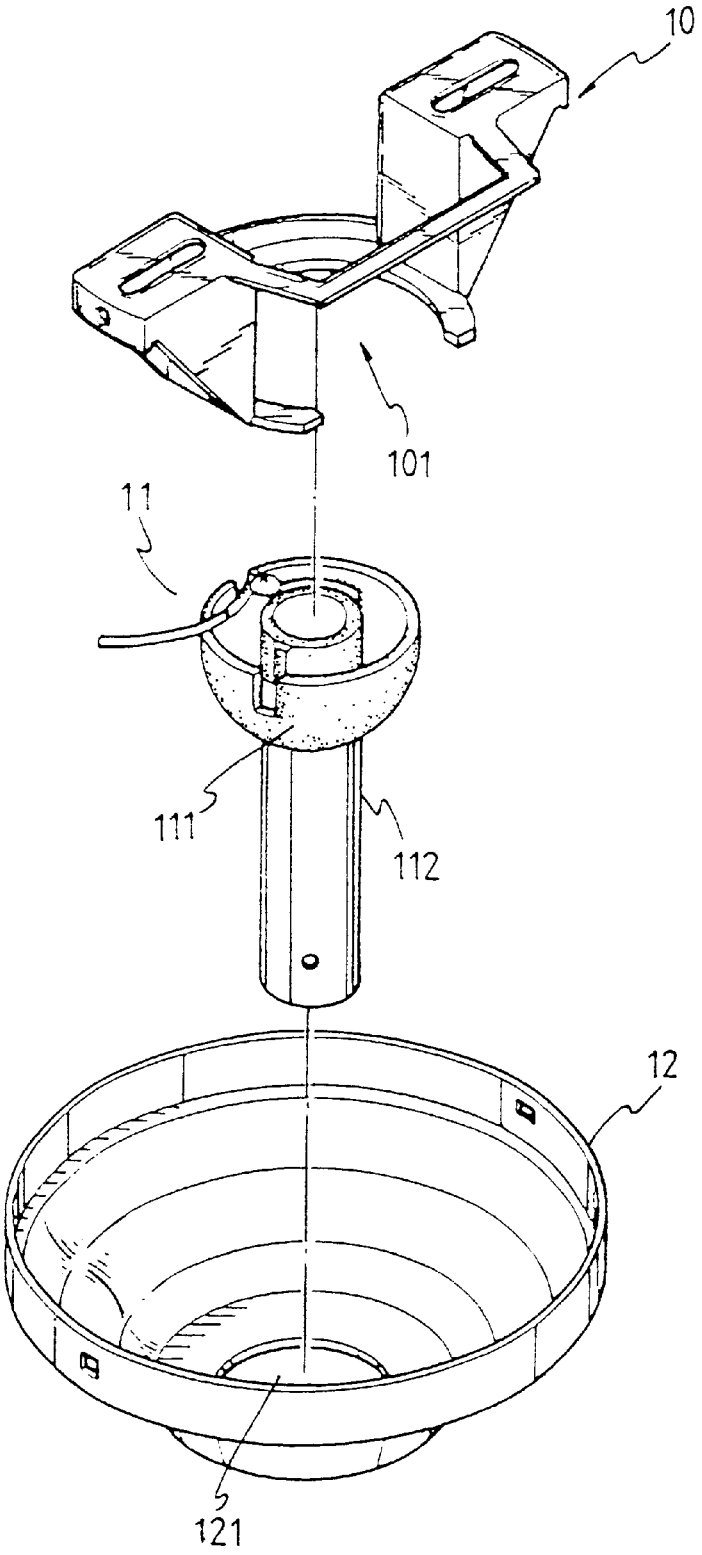
FIG.1 PRIOR ART
FIG. 1 is an exploded perspective view schematically showing the suspending structure of a prior art concave space.
Figure 2:
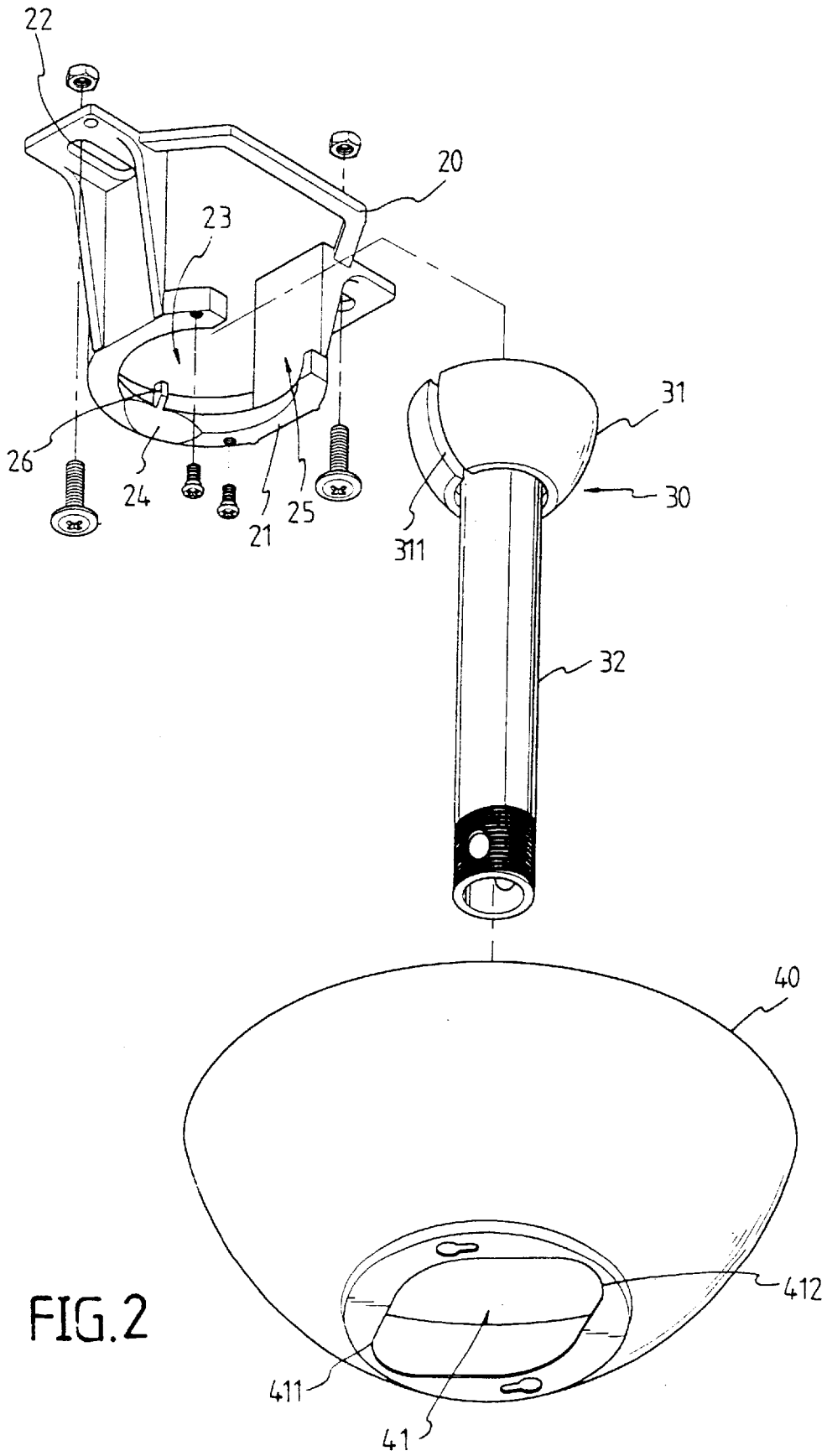
FIG. 2 is an exploded perspective view schematically showing the present invention.
Figure 3:
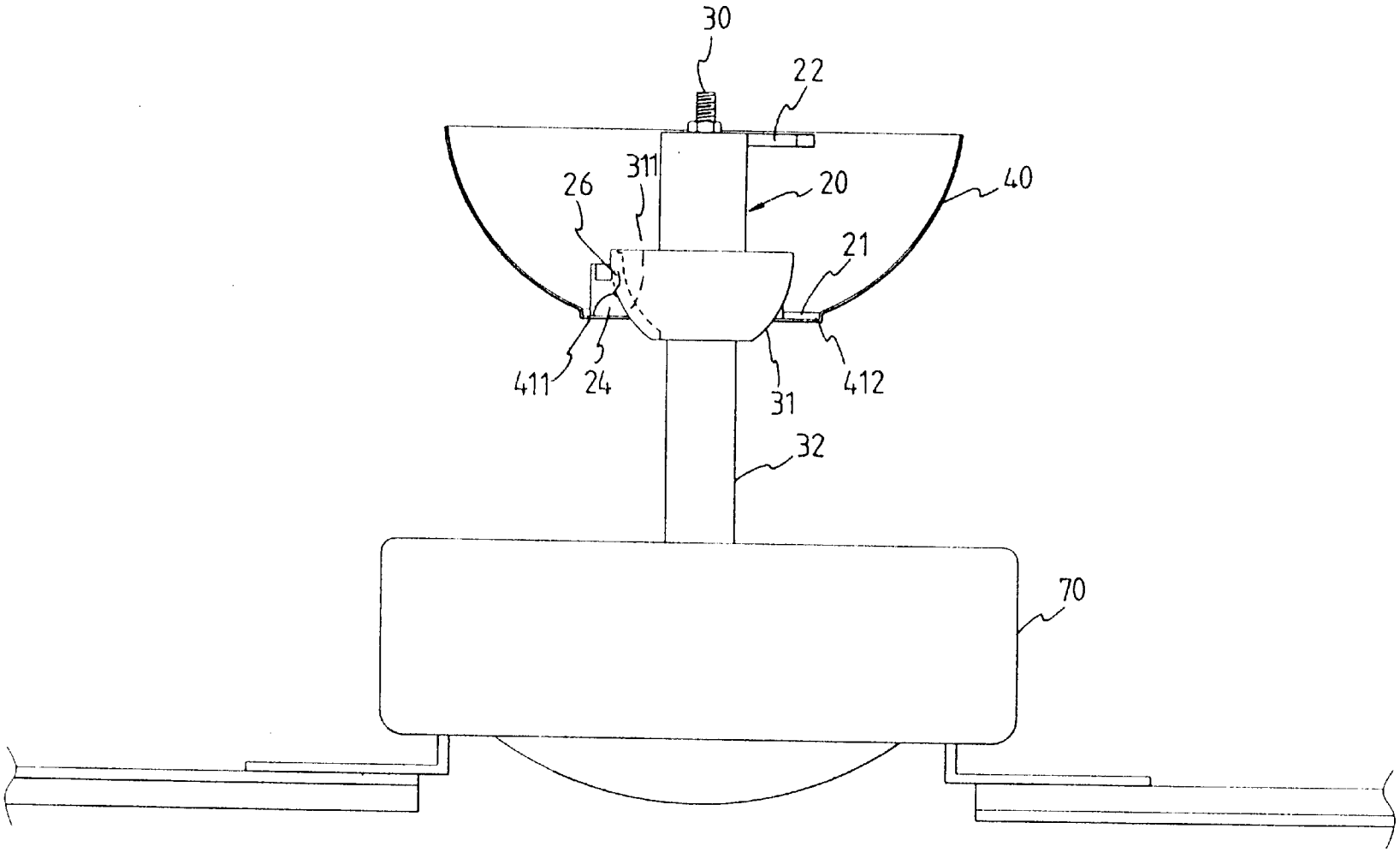
FIG. 3 is a plane schematic view showing the structure of the present invention.
Figure 4:
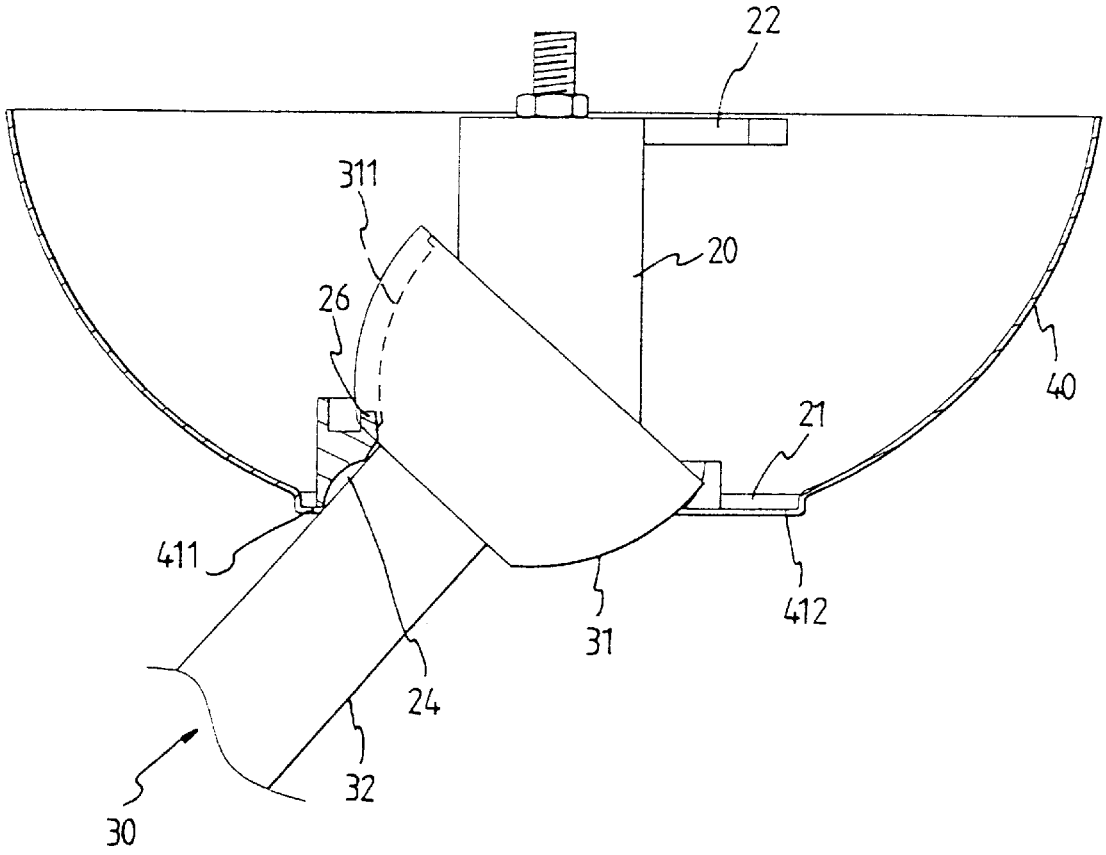
FIG. 4 is a first plane schematic view showing the operation about the structure of the present invention.

With reference to FIGS. 2 and 3, the suspending structure of a ceiling fan according to the present invention is illustrated. The suspending structure of the present invention mainly includes a suspender 20, a swinging pipe set 30 and a hanging bell 40.

The suspender 20 is installed with a frame 21 and two sets of fixing ears 22. The frame 21 is installed with an assembly hole 23. The fixing ears serve to combine with an assembling surface 50 (for example, a ceiling). A cavity 24 and opening 25 are installed at opposite sides of the frame 21 in the suspender 20. The frame 21 at one side of the cavity 24 is protruded with a buckle 26.

One end of the swinging pipe set 30 is formed as a hanging head as a hemisphere, while another end is formed as a swinging pipe 32. A trench 311 is formed on the hanging head 31. The swinging pipe set 30 can be installed to the assembly hole 23 of the suspender 20 through the hanging head 31. The buckle 26 is embedded into the trench 311 and is swingable therein.

The hanging bell 40 is disposed as a cover, and an engaging hole 41 is formed thereon. The engaging hole 41 is an opening with long sides and short sides. The swinging pipe 32 can pass through the engaging hole 41 to combine the hanging bell 40 with the suspender 20 as a shielding cover of the suspending structure. The first end 411 and second end 412 at the long side of the engaging hole 41 are located at positions with respect to the cavity 24 and opening, respectively.

Thereby, after the aforesaid suspender 20, swinging pipe set 30, hanging bell 40 are assembled, the buckle 26 is embedded into the trench 311, and the first end 411 and second end 412 at the long sides of the engaging hole 41 are placed at the cavity 24 and opening 25 of the suspender 20. Thereby, as the swinging pipe set 30 swings toward the first end 411 of the engaging hole 41, the swinging pipe 32 can be received within the cavity 24 (not to be hindered by the frame). Therefore, the swinging pipe set 30 may swing along a large traveling length. Moreover, the swing track is confined by the buckle 26 and the trench 311. That is, the swing path is along the trench 311. It is appreciated that the maximum swing length is wider than that in the prior art, and the structure is steady and safe.

Figure 5:
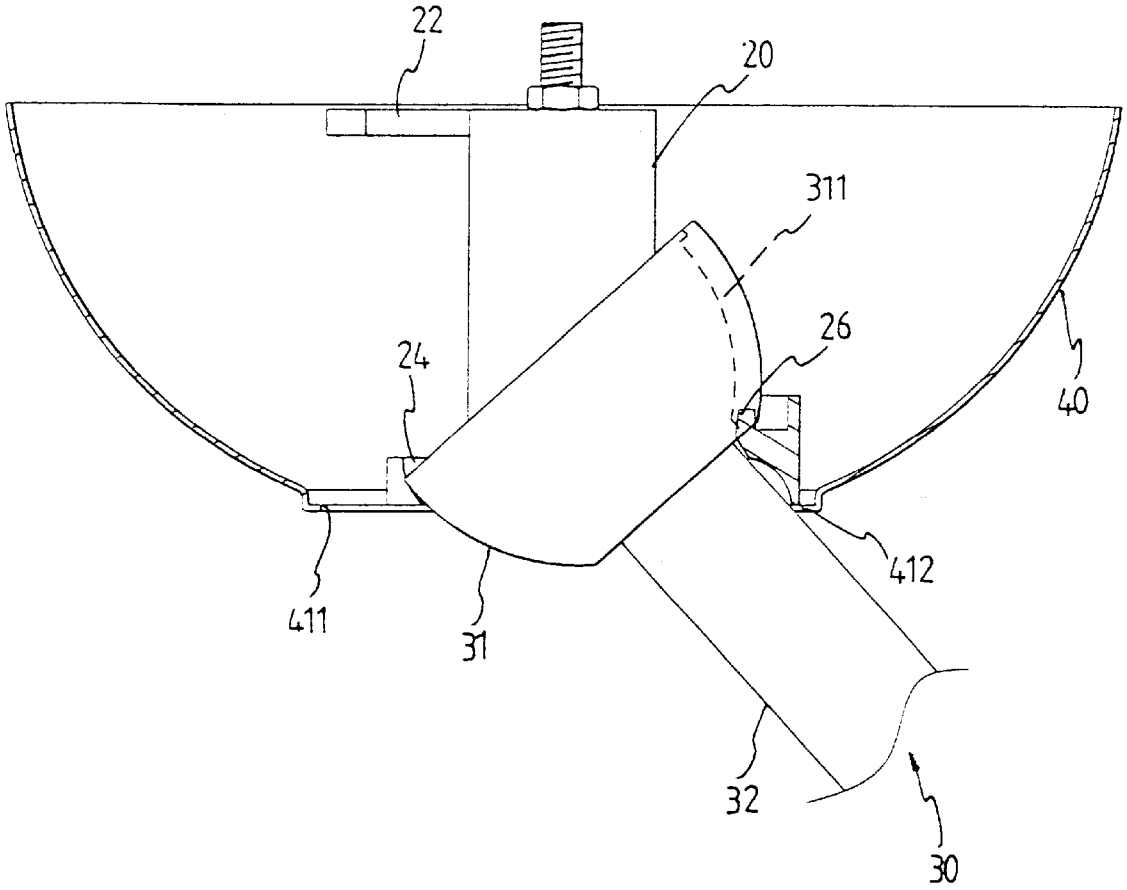
FIG. 5 is a second plane schematic view showing the operation about the structure of the present invention.
Figure 6:
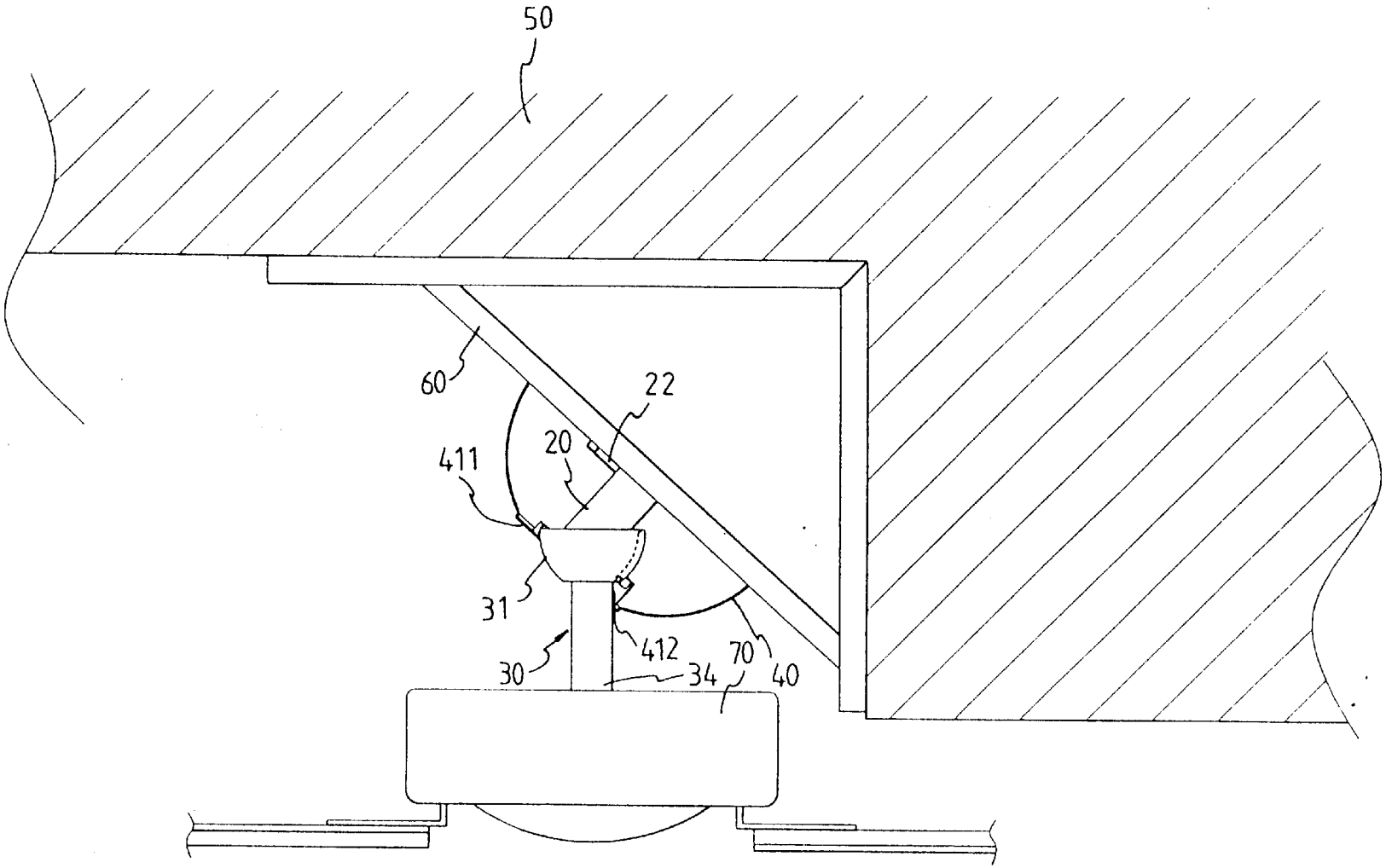
FIG. 6 is a plane schematic view showing another embodiment of the present invention.

If should be noted, referring to FIG. 5, as the swinging pipe set 30 swings toward the second end 412 of the engaging hole 41, the orientation of the suspender 20 is changed so that the cavity is at position with respect to the second end 412, and opening 25 is at position with respect to first end 411 (in FIG. 5, the cavity is with respect to the first end, and the opening is with respect to the second end).

Moreover, in the present invention, an angled frame 60 serves to install the ceiling fan with a shift to the horizontal direction, or serves to install the ceiling fan at wall or between beams, as shown in FIG. 5. In general, as a ceiling fan is installed, it is general that the ceiling fan is not installed at the connections of the beams or walls, or angled wall. However, these will cause the places for installing the ceiling fan is confined greatly. Since the suspending structure of a ceiling fan in the present invention can be used in a non-horizontal surface (50), and therefore, as shown in the figures, the angled frame 60 is firmly secured to places such as connections of beams and walls, and then the suspending structure of the present invention is firmly secured thereto (the suspender 20 is combined with the angled frame 60). That is, the concave space can be installed to a surface (50) with a large angle therebetween.

In summary, in the present invention, as it is embodied, two sides of the assembly hole of the suspender are installed with cavity and opening, and the engaging hole of the hanging bell is formed with long sides. Two ends of each long side are placed at the cavity and opening of the suspender, Therefore, as the swinging pipe set swings toward the cavity, the swinging pipe can be received within the end of the long side of the cavity so that a large swing is tolerable. Moreover, by the engagement of the buckle and the trench, the suspending structure of a ceiling fan according to the present invention can be safely installed to a non-horizontal surface with a large angle shift.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A suspending structure of a ceiling fan comprising:

a suspender formed with a frame and fixing ears, an inner side of said frame being formed with an assembly hole with an opening, and said fixing ear being capable of being combined with a predetermined installing surface;

a swinging pipe set, one end of said swinging pipe being formed with a hanging head having a hemisphere shape, while another end thereof being formed by a swinging pipe; said swinging pipe set being installed to said assembly hole of the suspender by said hanging head thereof and then being swingable;

a hanging bell being a cover, an engaging hole being installed thereon, thereby, said swinging pipe can pass through said engaging hole to combine said hanging bell with said frame;

characterized in that: a cavity and an opening are installed at two opposite sides of said frame of said suspender, a buckle protrudes from said frame at one side of said cavity, and a trench is formed on said hanging head, said engaging hole is formed as a hole with long sides; as said hanging head is received into said assembly hole and said swinging pipe passes through the assembly hole, then the buckle will be embedded into said trench, and two ends of said long sides of said engaging hole are at positions with respect to said cavity and said opening, thereby, as the swinging pipe set shifts toward said cavity, said swinging pipe is received within one end of said long side of the cavity, and therefore, a swing of large angle is generated, moreover, said swinging path of the swinging pipe set is confined by said buckle and said trench.

2. The suspending structure of a ceiling fan as claimed in claim 1, wherein said suspender is used with an angled frame, then said angled frame is installed to a non-horizontal surface.

* * * * *